United States Patent [19]

Schubeis

[11] 4,128,977

[45] Dec. 12, 1978

[54] DOOR FRAME, ESPECIALLY FOR FIREPROOF DOORS

[76] Inventor: Ewald I. E. Schubeis, Tegnergatan 9, S-111-40 Stockholm, Sweden

[21] Appl. No.: 608,715

[22] Filed: Aug. 28, 1975

Related U.S. Application Data

[63] Continuation-in-part of Ser. No. 412,802, Nov. 5, 1973, abandoned.

[51] Int. Cl.[2] ..... E06B 1/04

[52] U.S. Cl. ..... 52/212; 52/217

[58] Field of Search ..... 52/212, 217, 211, 213, 52/214; 49/505

[56] References Cited

U.S. PATENT DOCUMENTS

| | | | |
|---|---|---|---|
| 1,180,726 | 4/1916 | Keil | 52/212 |
| 1,715,579 | 6/1929 | Thye | 52/212 |
| 2,773,571 | 12/1956 | Kelly | 52/212 |
| 2,860,744 | 11/1958 | Mascari | 52/212 |
| 2,913,777 | 11/1959 | Viets | 49/505 |
| 3,420,003 | 1/1969 | Cline | 52/212 X |
| 3,571,996 | 3/1971 | Braswell | 49/505 |
| 3,626,639 | 12/1971 | Di Lucia | 49/505 |

FOREIGN PATENT DOCUMENTS

| | | | |
|---|---|---|---|
| 262577 | 6/1968 | Austria | 49/505 |
| 1365376 | 5/1964 | France | 52/213 |
| 1385545 | 12/1964 | France | 52/212 |
| 362280 | 10/1972 | Sweden | 52/208 |
| 408375 | 9/1966 | Switzerland | 49/505 |
| 449218 | 4/1968 | Switzerland | 49/505 |

*Primary Examiner*—Leslie Braun
*Attorney, Agent, or Firm*—Cushman, Darby & Cushman

[57] ABSTRACT

The present invention concerns a door frame comprising a first and a second frame portion. Each frame portion is assembled from four plate strips bent into a substantially L-like profile form, and the frame portions are insertable into a door opening in a wall from the opposite sides thereof in such a way that a first profile leg of all plate strips of each frame portion engages the outer surface of said wall around the door opening while the second profile leg of said frame portion plate strips extends into the door opening and overlap each other therein so as to cover the side edge of said door opening. In this position the two frame portions are interconnected by a number of threaded joints. The inventive concept of the invention resides in the fact that each threaded joint consists of one fixed rod and one rotatable rod provided with cooperating threads. One end of the fixed rod is fastened to the first profile leg of the first frame portion and extends parallelly with and spaced from the second profile leg thereof. The rotatable rod is universally journalled in the first profile leg of the second frame portion. Upon insertion of the frame portions into the door opening, the fixed rod and the rotatable rod of each threaded joint oppose each other and can be screwed together. The second leg portion of the second frame portion thereby entering the gap between the fixed rod and the second profile leg of the first frame portion, said gap being slightly wider than the thickness of the second profile leg of the second frame portion to guide said frame portions during the mounting thereof.

10 Claims, 1 Drawing Figure

DOOR FRAME, ESPECIALLY FOR FIREPROOF DOORS

CROSS-REFERENCE TO RELATED APPLICATION

This is a continuation-in-part of Ser. No. 412,802, filed Nov. 5, 1973, now abandoned.

BACKGROUND AND SUMMARY OF THE INVENTION

The present invention concerns a door frame, especially but not exclusively meant for fireproof doors, said door frame covering the edge sides of a door opening in a wall and consisting of two frame portions assembled from plate profiles bent substantially in L-form, said frame portions being mounted in said door opening in such a way that one leg of each plate profile engages the outside of said wall round said door opening and the other profile leg thereof extends into said door opening substantially parallel with the edge side thereof and overlaps the corresponding profile leg of the other frame portion inside of said door opening.

A number of different ways and means for the mounting of door frames of this kind have already been suggested. It is thus already known to provide one of the frame portions with tabs protruding into the door opening and being nailed fast against the edge side thereof during the mounting. The other frame portion is thereafter usually joined to the frame portion attached in the door opening by means of rivets which are inserted through holes provided during the mounting, or through a pair of holes, which are aligned with each other during the mounting. It is also known to arrange a toothed projection on one of the frame portions, which during the mounting is brought into engagement with a fastening member of the other frame portion to retain said frame portions at a distance from each other determined by the thickness of said wall.

Another prior art device is shown in U.S. Pat. No. 1,180,726. In such a device, two frame members are drawn together by a threaded rod connection, however, the cooperating portions of the threaded rod connection are telescoped together. This provides positive guiding of the frame members, and they therefore cannot adapt to deviations in the parallelism of the outer surfaces of the wall to which they are to be attached. Also, no overlap is provided between the legs extending into the door opening, but merely an overlap between a door abutment surface attached to one leg and the other leg, the other leg also having no portion of the threaded rod connection formed inwardly thereof for preventing damage thereto upon inward movement thereof (toward the wall). Thus it will be seen that the door frame according to the present invention does not have many of the disadvantages of the prior art structures, such as being relatively expensive and/or not being able to adapt to deviations in wall surface parallelism, etc.

It is the primary object of the present invention to provide an improved door frame construction, especially for fireproof doors. This and other objects of the invention will become clear from an inspection of the detailed description of the invention and from the appended claims.

BRIEF DESCRIPTION OF THE DRAWINGS

Two embodiments of the invention will now be described with reference to the attached drawing, on which FIG. 1 in cross section shows a frame side of a door frame according to the invention of the principally simplest form thereof and FIG. 2 in a similar view a development of the inventive concept, the frame portions being shown in dash-dot lines before the mounting is completed.

DETAILED DESCRIPTION OF THE INVENTION

Figure 1:
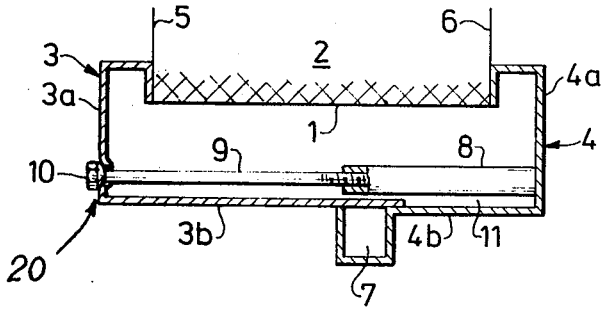

As stated in the aforesaid the door frame according to the present invention is meant to cover the side edge 1 of a door opening in a wall 2. The door frame consists of two frame portions 3 and 4 assembled of profile plates bent to a substantially L-shaped form. In the mounted position one profile leg 3*a* and 4*a* of each frame portion 3 and 4, respectively, strongly engages the adjacent outer surface 5 and 6, respectively, of the wall round the door opening. If desired, the edges of said profile legs 3*a* and 4*a* can be bent inwardly at right angles to the profile leg and comprise an edge flange parallel to said leg, which flange is pressed into engagement with the outer surface of the wall 2 when the door frame is mounted. The other profile legs 3*b* and 4*b* of the L-shaped profile plates are intended to extend into the door opening substantially parallel with the edge side 1 thereof and to overlap each other within the door opening. One of said profile legs may in a known manner be bent in such a way as to form an abutment 7 for a door leaf. The door frame described above is formed in a conventional manner.

According to the invention a number of rods 8 with one of their ends are rigidly connected to one of the frame portions on the inside of the profile leg engaging the outer surface 5 or 6 of the wall 2, i.e., to the profile leg 4*a* of the frame portion 4 as shown on the drawing. Said rods are spaced round the door frame, for instance at least two rods being arranged on each one of the vertical frame sides. The rods 8 extend at right angles to the profile leg 4*a* and the free ends thereof thus facing the corresponding profile leg 3*a* of the cooperating frame portion 3. A bore extends from the free end of each rod 8 a substantial distance into same and said bore is provided with internal threads.

A hole is provided in the other frame portion 3 in the corresponding profile leg 3*a* thereof opposite each rod 8. Said holes are arranged to accommodate rotatable rods 9, preferably in the form of threaded bolts having hexagonal heads 10 or similar means on the outside of said profile leg 3*a*. As shown at 20 in FIG. 1, the rotatable threaded rod 9 may be universally swingably mounted in the profile leg 3*a* to assist in adapting the structure to a wall 2 having outer surfaces 5, 6 thereof of different parallelism. The bolt heads 10 have curved bottom portions 21 which cooperate with correspondingly curved depressions 22 formed in profile leg 3*a* in order to provide for the universal swingable mounting of the rotatable rods 9 in the profile leg 3*a*.

When the door frame is to be mounted, the frame portions 3 and 4 are inserted in proper positions into said door opening and the bolts 9 are brought into engagement with the threaded holes of the rods 8. By rotation of the bolts 9 the frame portions 3 and 4 are pressed against each other and the profile legs 3*a* and 4*a* are forced into strong engagement against the opposite outer surfaces 5 and 6, respectively, of the wall 2, so that the door frame is immovably retained in the door opening.

To facilitate this mounting the rigid rods 8 are preferably arranged on the frame portion, whose profile leg **4*b* extending into the door opening is situated at the greatest distance from the edge side 1 of the door opening. The rod 8 is thereby placed at such a distance from the profile leg 4*b* that a gap 11 is formed therebetween. The gap 11 shall have such a width that it can accommodate the profile leg 3*b* of the other frame portion 3, which enters into the door opening, and guide said profile leg during the mounting. These features provide for adaptation of the structure to accommodate a wall 2 having outer surfaces 5, 6 of different parallelism. Also, although the gap 11 is large enough to accommodate the profile leg 3*b* and allow movement thereof to adapt to wall outer surfaces 5, 6 of different parallelism, it is not so large that the profile leg 3*b* may be damaged by forced movement toward the wall 2 without first abutting the fixed rod 8**.

Figure 2:
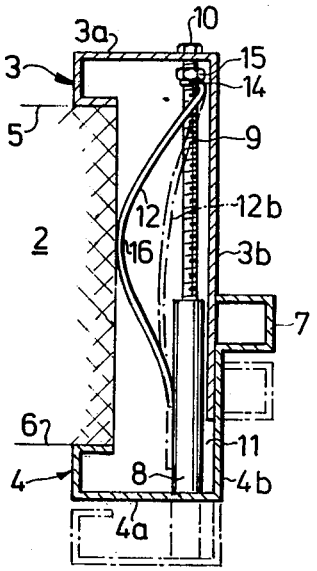

The embodiment of FIG. 2 corresponds in all essentials with the one described in the aforesaid and the means already described have therefore been provided with the same reference numerals and will not again be described in detail.

In the embodiment of FIG. 2 one end of a bar 12 of flat iron is attached to the root end of the rigid rod 8 and extends as an arch inwardly towards the edgeside 1 of the door opening and thereafter outwardly towards the rotatable rod 9 of the outer frame portion 3. The free end 14 of the bar 12 is bifurcated and the prongs thereof are situated on opposite sides of said rotatable rod or bolt 9. Said bifurcated end 14 abuts against a shoulder 15 which preferably is arranged on said rotatable rod 9, and to ensure proper abutment the outer end of said prongs are bent in the direction of said edge side 1.

In the unmounted condition the curvature of said bar 12 is relatively small, i.e., the radius of curvature thereof is great as shown by a thick dash-dot line **12*a* in FIG. 2. When the frame portions 3, 4 during the mounting are displaced towards each other upon rotation of the bolt 9, the shoulder 15 is also displaced to approach the point of attachment of the bar 12, so that said bar 12 is more strongly arched, i.e., is given a smaller radius of curvature, as shown in full lines on FIG. 2. The apex portion 16 of said bar 12 is thereby pressed into abutment against the adjacent edge side 1 of the door opening and the door frame is thereby maintained fixed against displacement in the plane of the wall and the profile legs 3*b* and 4*b*** overlapping each other are strongly pressed together, so that no gap is present therebetween.

According to FIG. 2 the shoulder 15 is formed by a nut which is screwed on to said bolt 9. Before commencing the mounting said nut may be moved to a suitable position along the bolt 9 so that sufficiently strong arching of the bar 12 is obtained to press same against said edge side 1. The nut 15 is preferably locked in the desired position by means known per se.

By forming a door frame as described above, a very simple and inexpensive construction is provided that will automatically adapt to walls having outer surfaces of different parallelism, fulfilling the objects of the present invention. While the invention has been herein shown and described in what is presently conceived to be the most practical and preferred embodiments of the invention, it will be apparent to those of ordinary skill in the art that many modifications may be made thereof within the scope of the invention, which scope is to be accorded that broadest interpretation of the appended claims so as to encompass all equivalent structures and devices.

What is claimed is:

1. A door frame, especially for fireproof doors, comprising (a) a first frame portion assembled from a plate strip and bent into a substantially L-like profile having a first and a second profile leg, said second profile leg having formed at the end thereof a door abutment portion, (b) a second frame portion assembled from a plate strip and bent into a substantially L-like profile having a first and second profile leg, (c) said first and second frame portions being arranged in a door opening in a wall in such a way that the first profile legs of said frame portions engage the opposite outer surfaces of said wall around said door opening, and said second profile legs of said first and second frame portions extend into said door opening substantially parallel with the edge side thereof and overlap each other within the door opening, said door abutment portion also being overlapped said second profile leg of said first frame portion being outermost, (d) means for interconnecting said first and second frame portions, said means comprising a plurality of threaded joints, each threaded joint including a fixed rod and a rotatable rod having threads cooperating with threads on said fixed rod, said fixed rod connected at one end thereof to the first profile leg of the first frame portion and being spaced therefrom a distance greater than the thickness of said second profile leg of said second frame portion, and (e) means for allowing continuous adjustability of the door frame to provide for different wall thickness and to provide for deviations of the parallelism of the outer surfaces of said wall upon suitable selective tightening of said threaded joints, said means including (i) said second profile leg of said second frame portion being movable between the overlapping section of said second profile leg of said first frame portion and said fixed rod in the space therebetween and being able to assume an angle with respect to said fixed rod to adapt to deviations in parallelism of the outer surfaces of said wall, and (ii) said second profile leg of said second frame portion overlapping and being guided by said second profile leg of said first frame portion, and (iii) means for universally swingably mounting each of said rotatable rods in said first profile leg of said second frame portion, said universally swingably mounting means comprising cooperating curved portions of the head of each of said rotatable rods and a depression in said first profile leg of said second frame portion.

2. A door frame as recited in claim 1 wherein said distance between each of said fixed rods and said second profile leg of said first frame portion is only slightly greater than the thickness of said second profile leg of said second frame portion, so that deviations in the parallelism of the outer surfaces of said wall may be accommodated but so that significant lateral displacement of said second profile leg of said second frame portion toward said wall is prevented by said fixed rod so that no damage results to said second profile leg portion of said second frame portion if subjected to forces moving it toward said wall.

3. A door frame, especially for fireproof doors, comprising (a) a first frame portion assembled from a plate strip and bent into a substantially L-like profile having a first and a second profile leg, said second profile leg having formed at the end thereof a door abutment portion, (b) a second frame portion assembled from a plate strip and bent into a substantially L-like profile having a first and second profile leg, (c) said first and second frame portions being arranged in a door opening in a wall in such a way that the first profile legs of said frame portions engage the opposite outer surfaces of said wall around said door opening, and said second profile legs of said first and second frame portions extend into said door opening substantially parallel with the edge side thereof and overlap each other within the door opening, said door abutment portion also being overlapped said second profile leg of said first frame portion being outermost, (d) means for interconnecting said first and second frame portions, said means comprising a plurality of threaded joints, each threaded joint including a fixed rod and a rotatable rod having threads cooperating with threads on said fixed rod, said fixed rod connected at one end thereof to the first profile leg of the first frame portion and extending parallel to the second profile leg of the first frame portion and being spaced therefrom a distance greater than the thickness of said second profile leg of said second frame portion, (e) means for allowing continuous adjustability of the door frame to provide for different wall thickness and to provide for deviations of the parallelism of the outer surfaces of said wall upon suitable selective tightening of said threaded joints, said means including said second profile leg of said second frame portion being movable between the overlapping section of said second profile leg of said first frame portion and said fixed rod in the space therebetween and being able to assume an angle with respect to said fixed rod to adapt to deviations in parallelism of the outer surfaces of said wall, and said second profile leg of said second frame portion overlapping and being guided by said second profile leg of said first frame portion, and (f) a number of bars are arranged in parallel with said rods between said second profile legs and the edge side of said door opening, which bars at the one end are fastened to said first frame portion and are slightly convexly bent in the direction towards said side edge of the door opening with their free ends engaging a shoulder of said second frame portion, the bend of said bars increasing upon displacement of said frame portions towards each other, so that the apex portions of the bars are pressed into abutment against said side edge of the door opening.

4. A door frame as claimed in claim 3, characterized in that said firstmentioned end of one such bar is fastened to each fixed rod, the free end of said bar being bifurcated and straddeling said rotatable rod which supports said shoulder.

5. A door frame as claimed in claim 4, characterized in that said shoulder has the form of a nut screwed onto said rotatable rod which consists of a threaded bolt.

6. A door frame, especially for fireproof doors, comprising, (a) a first frame portion assembled from a plate strip and bent into a substantially L-like profile having a first and second profile leg, (b) a second frame portion assembled from a plate strip and bent into a substantially L-like profile having a first and second profile leg, (c) said first and second frame portions being arranged in a door opening in a wall in such a way that the first profile legs of said frame portions engage the opposite outer surfaces of said wall around said door opening, and said second profile legs of said first and second frame portions extend into said door opening substantially parallel with the edge side thereof and overlap each other within the door opening, said second profile leg of said first frame portion being outermost, (d) means for interconnecting said first and second frame portions, said means comprising a plurality of threaded joints, each threaded joint including a fixed rod and a rotatable rod having threads cooperating with threads on said fixed rod, said fixed rod connected at one end thereof to the first profile leg of the first frame portion and extending parallel to the second profile leg of the first frame portion and being spaced therefrom a distance greater than the thickness of said second profile leg of said second frame portion, and (e) means for allowing continuous adjustability of the door frame to provide for different wall thickness and to provide for deviations of the parallelism of the outer surfaces of said wall upon suitable selective tightening of said threaded joints, said means including said second profile leg of said second frame portion being movable between the overlapping section of said second profile leg of said first frame portion and said fixed rod in the space therebetween, said second profile leg of said second frame portion overlapping and being guided by said second profile leg of said first frame portion, and means fo universally swingably mounting each of said rotatable rods in said first profile leg of said second frame portion, said universally swingably mounting means comprising cooperating curved portions of the head of each of said rotatable rods and a depression in said first profile leg of said second frame portion.

7. A door frame as claimed in claim 6, characterized in that said rotatable rods comprise threaded bolts having tool engagement surfaces, situated on the outside of the first profile leg of said second frame portion, said fixed rods having the form of bushings with internal threads.

8. A door frame as claimed in claim 6 characterized in that a number of bars are arranged in parallel with said rods between said second profile legs and the edge side of said door opening, which bars at the one end are fastened to said first frame portion and are slightly convexly bent in the direction towards said side edge of the door opening with their free ends engaging a shoulder of said second frame portion, the bend of said bars increasing upon displacement of said frame portions towards each other, so that the apex portions of the bars are pressed into abutment against said side edge of the door opening.

9. A door frame as claimed in claim 8, characterized in that said firstmentioned end of one such bar is fastened to each fixed rod, the free end of said bar being bifurcated and straddeling said rotatable rod which supports said shoulder.

10. A door frame as claimed in claim 8, characterized in that said shoulder has the form of a nut screwed onto said rotatable rod which consists of a threaded bolt.

* * * * *